US005640867A

United States Patent [19]

Massée

[11] Patent Number: 5,640,867

[45] Date of Patent: Jun. 24, 1997

[54] METHOD AND APPARATUS FOR FORMING A RIM ON A LAMP REFLECTOR

[76] Inventor: Johan Massée, Vijfsprongweg 104, 6741 JC Lunteren, Netherlands

[21] Appl. No.: 458,464

[22] Filed: Jun. 2, 1995

[30] Foreign Application Priority Data

Jun. 8, 1994 [NL] Netherlands ..... 9400927

[51] Int. Cl.[6] ..... B21D 19/04

[52] U.S. Cl. ..... 72/84; 72/86

[58] Field of Search ..... 72/84, 85, 86, 72/87, 101, 110

[56] References Cited

U.S. PATENT DOCUMENTS

| | | | |
|---|---|---|---|
| 942,062 | 12/1909 | Gabriel | 72/101 |
| 2,097,691 | 11/1937 | Fiegel . | |
| 2,124,741 | 7/1938 | Knudsen | 72/101 |
| 2,498,686 | 2/1950 | Johnson . | |
| 4,862,719 | 9/1989 | Kajrup et al. | 72/105 |

FOREIGN PATENT DOCUMENTS

| | | |
|---|---|---|
| 445721 | 7/1972 | Australia . |
| 476588 | 5/1929 | Germany . |

*Primary Examiner*—Lowell A. Larson
*Attorney, Agent, or Firm*—Westman, Champlin & Kelly, P.A.

[57] ABSTRACT

In a method of forming a rim on a lamp reflector, a forming roller is positioned on one side of the reflector rim to be formed and a support roller is positioned on the other side. The reflector is rotated about its center axis and the rollers are rotated with the same circumferential speed as the reflector rim. Then the rollers are moved such relative to each other and to the reflector that the rim is flanged between the rollers. The forming roller is moved such that the final tangent line of the circumferential face of this roller to the reflector rim is tilted about a pivot point which is positioned substantially on the bending line of the reflector rim. The invention also includes an apparatus for performing this method.

10 Claims, 2 Drawing Sheets

METHOD AND APPARATUS FOR FORMING A RIM ON A LAMP REFLECTOR

The present invention relates to a method of forming a rim on a lamp reflector, wherein a forming roller is positioned on one side of the reflector rim to be shaped and support roller on the other side, whereafter the reflector is rotated with the same circumferential speed as the reflector rim and the rollers are moved relative to each other and to the reflector in such way that the rim is flanged.

In a prior art method of this type, the forming roller is a truncate ball-shaped roller of which a rotation axis is inclined relative to the rotation axis of the supporting roller which is perpendicular to the center axis of the reflector. To form the reflector rim, the forming roller is moved perpendicularly outwardly with respect to the reflector while leaving a gap between the rollers between which the reflector rim is made. The tangent line of the support roller to the reflector rim determines the shape thereof, while the outwardly moving forming roller determines the deformation process. The control of the forming roller is based on position. This manner of displacing or controlling the forming roller leads to a poor surface quality of the reflector rim, often necessitating a finishing operation on a forming lathe. Furthermore, this method is only suitable for rims up to circa 5 mm.

The invention has now the object to provide a method of the type mentioned in the preamble in which this disadvantage is removed in an effective way.

For this purpose, the method according to the invention is characterized in that the forming roller is moved such that the final tangent line of the circumferential face of this roller to the reflector rim is tilted about a pivot point which is positioned substantially on the bending line of the reflector rim.

Through this pivoting movement of the forming roller, there is no sliding movement of the forming roller relative to the reflector rim thereby improving the surface quality. Furthermore it is possible to effect a "rolling operation" on the basis of force control. The material at the surface of the reflector rim can then be compressed which also contributes to the surface quality.

In order to obtain further material compression, it is possible according to the invention to move the support roller at least once parallel to the reflector rim in an abutting relationship with the reflector rim.

This embodiment of the method of the invention is particularly suited for reflectors which should be chemically brightened or anodized.

For reflectors of which the end rim has a larger material thickness, it is favourable when the support roller is moved a number of times in one direction along and in abutting relationship with the reflector rim and is moved back each time spaced from the reflector rim. Then it is possible that the support roller abuts to this reflector rim only with a short terminal circumferential face which is shorter than the width of this reflector rim.

The invention further includes an apparatus for forming a rim on a lamp reflector comprising a chuck for supporting the formed reflector, and for rotating the reflector about its centerline, a rotatable support roller having a supporting circumference to which the reflector rim will abut after deformation of this rim, and a rotatable and movable forming roller for flanging the reflector rim against the support roller, wherein, according to the invention, the forming roller is moved such that the final tangent line of the circumferential face of this roller to the reflector rim is tilted about a pivot point which is positioned substantially on the bending line on the reflector rim.

The invention will hereafter be elucidated with reference to the drawing schematically showing embodiments of the invention by way of example.

Figure 1:
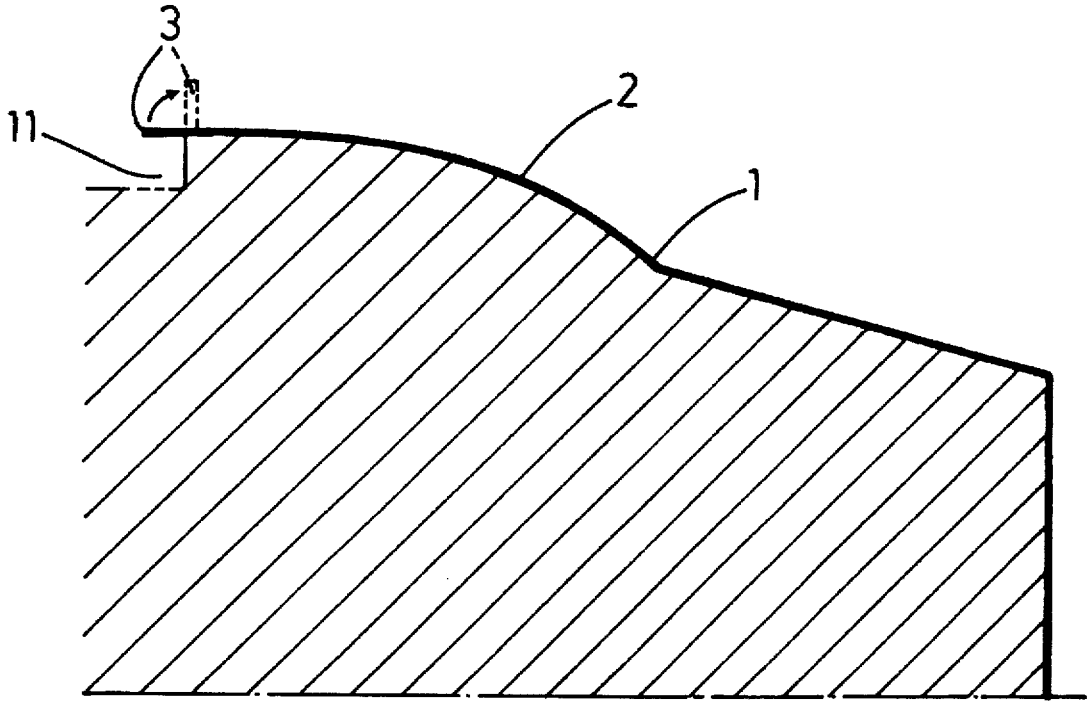
FIG. 1 is a schematic sectional view of a chuck having a formed lamp reflector thereon of which the end rim should be flanged.

The drawing and first of all FIG. 1 shows a chuck 1 serving as exchangeable chuck in a forming machine that is not further illustrated. A lamp reflector 2 having a circular transverse section is formed on the chuck 1 and a rim 3 at the open end of the reflector 2 should then be flanged outwardly in order to serve as mounting rim for the lamp reflector, for example.

FIG. 2–5 show four different embodiments of forming the rim 3. The means for forming the rim 3 include in all embodiments a support roller 4 and a forming roller 5. The support roller 4 is rotatable about a rotation axis 6 perpendicularly intersecting the center of the chuck 1. The circumferential edge 7 of the support roller 4 which is facing the chuck, determines the bending line of the reflector rim 3.

The forming roller 5 consists of a truncated cone-shaped roller which is not only rotatable about its rotation axis 8, but which is also tiltable according to arrow I by means of drive means not shown. The tilting axis of the forming roller 5 is tangent to an end edge 10 of the chuck 1 determining the bending or flanging line of the end edge 3 of the reflector 2 together with the circumferential edge 7 of the support roller 4. The tilting movement of the forming roller 5 may be guided by means of a guide having the shape of a circular segment which is concentrically about the tilting axis at the position of the end edge 10. A circumferential groove 11 in the chuck 1 enables the placement of the forming rollers 5 inwardly of the end edge 10 of the chuck 1.

Figure 2:
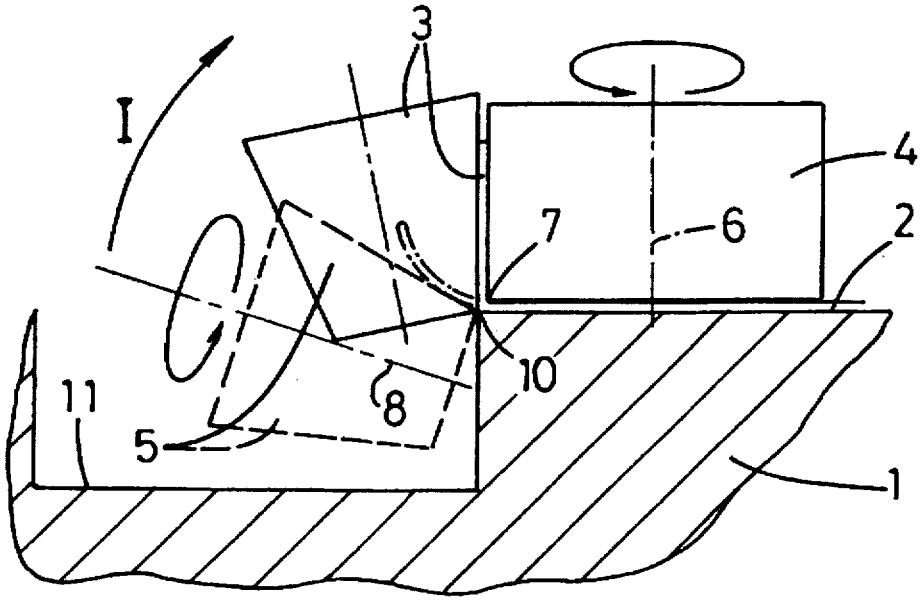
FIG. 2 shows on a larger scale detail II of FIG. 1 including schematically the means for flanging the reflector rim.

The method of forming the reflector rim carried out by the apparatus of FIG. 2 is as follows.

After forming the lamp reflector 2 about the chuck 1, the chuck 1 is rotated about the longitudinal centerline again while the support roller 4 is brought into the position of FIG. 2 and the support roller 4 will rotate about the rotation axis 6 with such rotational speed that the circumferential speed thereof will substantially correspond to the surface speed of the reflector rim 3 to be formed. The starting position of the forming roller 5 is shown in ghost lines in FIG. 2 and in which position the rotation axis of the forming roller 5 is parallel to or inclined at a small angle to the longitudinal centerline of the chuck 1. The reflector rim 3 will generally be deformed slightly during the formation of the lamp reflector, as shown in FIG. 2, but that is not important in the further process. The forming roller 5, like the support roller 4, is rotatable about its rotation axis 8 with such speed that the curremferential speed is substantially equal to the surface speed of the rim 3 to be formed. By rotating the chuck 1 together with the lamp reflector 2 and by slowly tilting the forming roller 5 in accordance with arrow I, the rim 3 will gradually be flanged by deformation and will finally be rolled between the rollers 4 and 5 with the forming roller 5 in the end position indicated by bold lines. The control of the forming roller 5 may be an open loop control based on force, that is forming roller 5 is tilted and is forced with a predetermend force or rolling pressure against the rim 3.

Figure 3:
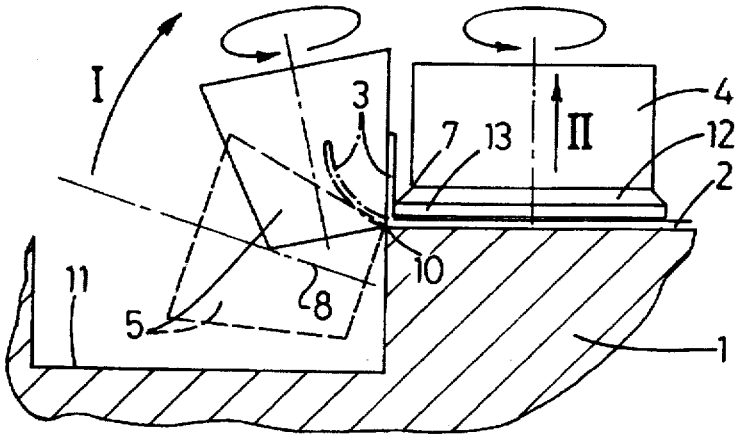
FIG. 3–5 are sectional views corresponding to FIG. 2 and illustrating alternative embodiments of the invention.

FIG. 3 shows a modification of the embodiment of FIG. 2 with is particularly suited in situations in which material compression of the reflector rim 3 should be carried out, contrary to the embodiment of FIG. 2 in which less material compression takes place, so that the embodiment is particularly suited for reflectors having facets and for spray painted surfaces. The embodiment of FIG. 3 is better suited for chemacally brightened or anodized reflectors. The difference to the embodiment of FIG. 2 is that the support roller 4 is provided on the end face adjacent the chuck 1 with a short support portion 12 having a circumferential end face 13 having a larger diameter than the remaining portion of the support roller 4. As a result, the support roller abuts the reflector rim only with a short circumferential end face 13 which is shorter than the width of the reflector rim 3 to be formed. In order to cover and roll the whole reflector rim 3 any way, the support roller 4 is displaceable outwardly in a direction according to arrow II parallel to the reflector rim 3, in this case in a direction to the rotation axis 6. During displacement of the support roller 4, the wall 3 is compressed and finished.

Figure 4:
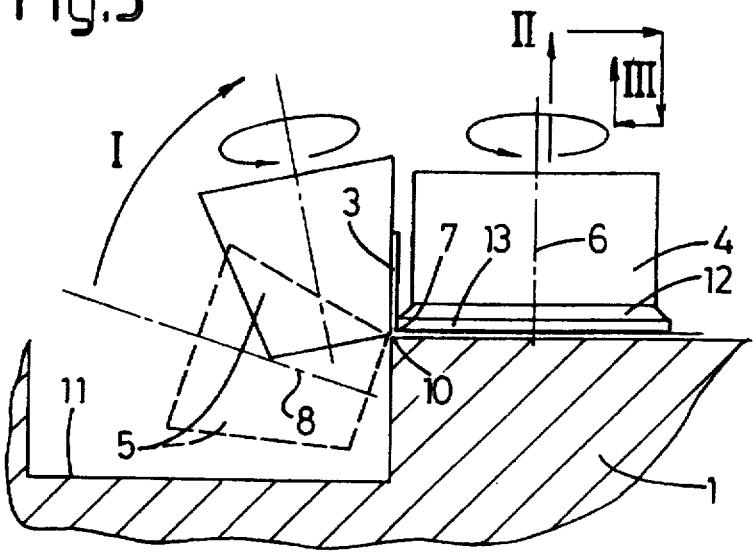

FIG. 4 shows an embodiment of the invention which is similar to FIG. 3, but wherein the support roller 4 can be moved a number of times in outward direction along the end rim 3 abutting this rim 3, while this supporting roller 3 is moved back each time spaced from the rim 3 by a lateral movement according to arrow III. This embodiment is particularly suited for thicker materials of the lamp reflector 2.

Figure 5:
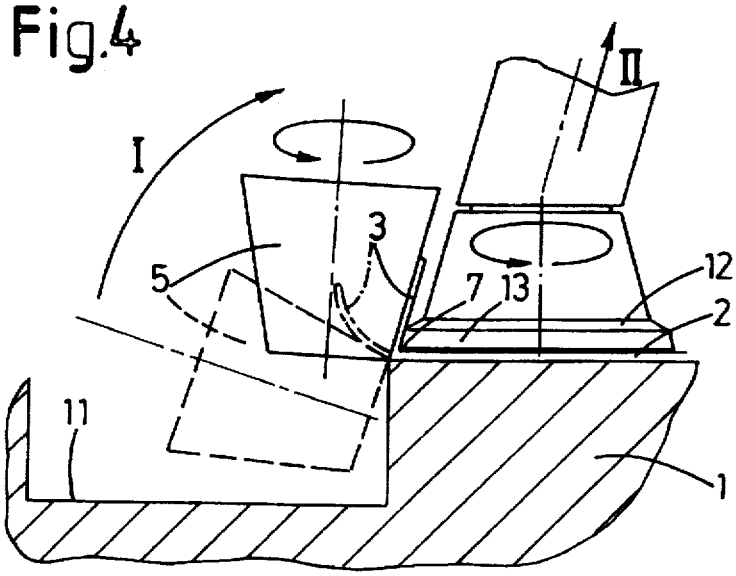

The embodiment of FIG. 5 is intended for rims 3 which should not be flanged perpendicularly but at a different angle. In this case, the rim 3 is deformed beyond the perpendicular plane, but it is also possible of course to flange the rim 3 to a smaller angle. In this embodiment the circumferential end face 13 is conical at the same angle as through which the rim 3 should be flanged. The rotation axis 6 of the support roller 4 is still perpendicular to the center line of the chuck 1, but the displacement according to arrow II of the support roller 4 is parallel to that of the end position of the rim 3, or at the same angle as the tangent of the circumferential end face 13 to the rim, adjacent to the forming roller 5, respectively. In fig.5 it is shown that the forming roller 5 is tilted through a larger angle as with FIG. 2–4.

The invention is not restricted to the embodiments shown in the drawing and discribed hereinbefore by way of example, which may be varied in different manners within the scope of the invention. The invention may for example also be used for round objects of which an end rim should be flanged.

I claim:

1. An apparatus for forming a flanged rim (3) at the open end of an object having a circular transverse section, comprising a chuck (1) for supporting the object (2) and for rotating the object about a centerline, a rotatable support roller (4) having a supporting circumference to which the object rim (3) will abut after the formation of the flanged rim, and a rotatable and movable forming roller (5) for flanging the rim (3) against the support roller (4), wherein the forming roller (5) is tilted to a tilted position relative to the support roller (4) about a tilting axis during flanging, and wherein the support roller (4) is movably suspended and displaceable in a direction parallel to a circumferential face of the forming roller (5) in the tilted position.

2. The apparatus of claim 1, wherein the tilting axis of the forming roller (5) is substantially tangent to an end edge (10) of the chuck (1).

3. The apparatus of claim 1, wherein the forming roller (5) has a shape of the truncated cone, and a truncated edge contacts the tilting axis.

4. The apparatus of claim 1, wherein a pivot axis is realized by means of a guide of the forming roller (5) which has a shape of a circular segment which is concentric about the pivot axis.

5. The apparatus of claim 1, wherein an end face of the support roller adjacent the chuck (1) comprises a short support portion (12) having a larger diameter than a remaining portion of the support roller (4).

6. The apparatus of claim 1, wherein the support portion (12) is conical.

7. A method of forming a rim (3) on an open end of an object (2) having a circular transverse section and a centerline, the method comprising:

positioning a forming roller (5) on one side of the rim (3) to be formed and a support roller (4) on a side of the rim (3) opposite the forming roller (5);

rotating the object (2) about the centerline and rotating the forming roller (5) and the support roller (4) at a speed approximately equal to a speed of the rim (3);

moving the forming roller (5) relative to the support roller (4) to form a flange on the rim (3) wherein a tangent line of a circumferential face of the forming roller (5) engaging the rim (3) is tilted about a pivot point positioned substantially on a bending line of the rim (3); and displacing the support roller (4) relative to the forming roller (5) and the rim (3) after the step of moving the forming roller (5), the support roller (4) being displaced parallel to the tangent line of the circumferential face while the support roller (4) engages the rim (3) and while the support roller (4) and the forming roller (5) are rotated.

8. The method according to claim 7, wherein the step of positioning comprises positioning the forming roller (5) on an inside surface of the flange to be formed and the support roller (4) on an outside surface of the flange to be formed.

9. The method according to claim 7, wherein the step of displacing comprises displacing the support roller (4) a number of times in one direction along and in abutting relationship with the object rim (3) and moving the support roller (4) back each time spaced from the object rim (3).

10. The method according to claim 7, wherein the support roller abuts the object rim (3) only with a short circumferential end face (13) which is shorter than a width of the object rim (3).

* * * * *

UNITED STATES PATENT AND TRADEMARK OFFICE

CERTIFICATE OF CORRECTION

PATENT NO. : 5,640,867

DATED : June 24, 1997

INVENTOR(S) : Johan Massée

It is certified that error appears in the above-indentified patent and that said Letters Patent is hereby corrected as shown below:

Column 4, line 20, replace "1" with --5--.

Signed and Sealed this

Seventh Day of October, 1997

*Attest:*

*Attesting Officer*

BRUCE LEHMAN

*Commissioner of Patents and Trademarks*